United States Patent [19]

Mahoney et al.

[11] 4,264,641

[45] Apr. 28, 1981

[54] ELECTROHYDRODYNAMIC SPRAYING TO PRODUCE ULTRAFINE PARTICLES

[75] Inventors: John F. Mahoney, South Pasadena; Julius Perel, Altadena; Kenneth E. Vickers, Sierra Madre, all of Calif.

[73] Assignee: Phrasor Technology Inc., Duarte, Calif.

[21] Appl. No.: 904,580

[22] Filed: May 10, 1978

Related U.S. Application Data

[63] Continuation-in-part of Ser. No. 778,351, Mar. 17, 1977, abandoned, and a continuation-in-part of Ser. No. 796,998, May 16, 1977, abandoned.

[51] Int. Cl.[3] ..... B05D 1/06

[52] U.S. Cl. ..... 427/30; 75/0.5 C; 264/10; 264/12; 425/6; 427/27; 427/422

[58] Field of Search ..... 427/13, 30, 422; 264/10, 12; 75/0.5 C; 425/6; 361/228

[56] References Cited

U.S. PATENT DOCUMENTS

| | | | |
|---|---|---|---|
| 1,958,406 | 5/1934 | Darrah | 361/228 |
| 2,658,009 | 11/1953 | Ransburg | 427/30 X |
| 2,754,225 | 7/1956 | Gfeller | 427/422 X |
| 2,980,338 | 4/1961 | Kozinski | 239/15 X |
| 3,041,672 | 7/1962 | Lyle | 264/10 |
| 3,114,654 | 12/1963 | Nishiyama et al. | 118/627 |
| 3,160,686 | 12/1964 | Doyle et al. | 264/10 |
| 3,352,950 | 11/1967 | Helton et al. | 264/10 |
| 3,416,153 | 12/1968 | Hertz et al. | 346/75 |
| 3,721,511 | 3/1973 | Schlienger | 264/10 X |
| 3,735,199 | 5/1973 | Ascoli | 361/228 |
| 3,830,603 | 8/1974 | Blucher et al. | 425/6 X |
| 3,911,161 | 10/1975 | Nord et al. | 427/30 |
| 3,963,812 | 6/1976 | Schlienger | 75/0.5 B X |
| 3,975,184 | 8/1976 | Akers | 75/0.5 B |

FOREIGN PATENT DOCUMENTS

| | | | |
|---|---|---|---|
| 990149 | 4/1965 | United Kingdom | 239/15 |
| 1159573 | 7/1969 | United Kingdom | 264/10 |

OTHER PUBLICATIONS

"Production of Ions by Electrohydrodynamic Spraying Techniques", Swatik, D. S. and Hendricks, C. D., AIAA Journal, vol. 6, No. 8, pp. 1596–1597, Aug. 1968.

*Primary Examiner*—Shrive P. Beck
*Attorney, Agent, or Firm*—Sherman & Shalloway

[57] ABSTRACT

Amorphous or microcrystalline alloy powder is prepared by the rapid quenching of ultrafine metallic spheroids generated from the molten metal state. The molten metal droplets are formed when an intense electric field ($10^5$ V/cm) is applied to the surface of liquid metal held in a suitable container. The interactions between the intense electric field and liquid surface tension disrupts the metal surface, resulting in a beam of positively charged droplets. The liquid metal spheres generated by this electrohydrodynamic process are subsequently cooled by radiative heat transfer. Rapid cooling of the droplets may be accomplished by heat transfer to a low pressure gas by free molecular heat conductivity. Quenching rates exceeding $10^6$ °K./sec are possible using this technique. Thin film coatings are prepared by electrohydrodynamically spraying a beam of charged droplets against a target (substrate). The target can be electrically controlled to effect the charged particles impact. The materials to be sprayed electrodynamically can be varied in both throughput and species such that a target can have multimaterial layers being deposited coincidentally or sequentially. The ultra small droplet size will enhance the physical properties by reducing skin stresses and enhance the optical properties by reducing the growth of crystallites in the film. Precise layers can be deposited from extremely thin films to thick filters for optical characteristics into the infrared. All materials that can be molten and contained can be electrohydrodynamically sprayed and controlled for depositions upon a substrate material.

9 Claims, 2 Drawing Figures

ELECTROHYDRODYNAMIC SPRAYING TO PRODUCE ULTRAFINE PARTICLES

This application is a Continuation In Part of application Ser. No. 778,351 filed Mar. 17, 1977 now abandoned and application Ser. No. 796,998 filed May 16, 1977 now abandoned.

BACKGROUND OF THE INVENTION

1. Field of the Invention

This invention relates to the electrohydrodynamic generation of sub-micron to micron size particles, to the rapid cooling and solidification of such particles, the preparation of amorphous metals, alloys, ceramics and the like from such particles, the application of thin film coatings from such particles, and the apparatus for electrohydrodynamically generating the sub-micron to micron size particles and for carrying out the rapid cooling and solidification and thin film coating applications as well as other applications.

2. Discussion of the Prior Art

The production of fine metal powders has been an active field of technology and many different approaches have been taken for the production of these metal as well as non-metal particles. For example, in U.S. Pat. No. 3,830,603 to Blucher, et al. the patentees mention many prior art techniques such as the atomization of molten metal by gas jets or by high pressure water; spraying molten metal into a vacuum to form discrete particles; the vaporization of metal in a vacuum followed by condensation; the fusion of metal by an electric arc followed by the formation of condensed droplets which may be forced out of the arc zone either by means of a gas stream or by centrifugal force either alone or coupled with the influence of the magnetic repulsion inherent in the arc; forming a molten surface on a metal rod and agitating the molten metal at ultrasonic frequency generated either by an ultrasonic transducer or by use of a high frequency electric current coupled with a strong direct current magnetic field. The processes of these prior art references are carried on either in the presence of an inert gas or in a vacuum. The Blucher, et al. apparatus produces fine metal powder from a wire or rod by forming particles of molten metal in an electric arc and removing the formed particles by the interaction of two magnetic fields operating at right angles to one another.

While these devices have achieved some degree of success, there is still a need for a more efficient means of obtaining even finer size particles from a broader range of materials than can be accomplished by any of the above mentioned techniques.

It has been possible by electrohydrodynamic spraying techniques to produce singly charged ions and heavier sub-micron particles as described, for example, by Swatik and Hendricks, "Production of Ions by Electrohydrodynamic Spraying Techniques" J. AIAA, Vol. 6, 1596–7 (August 1968); Mahoney, et al., "Electrohydrodynamic Ion Source", J. Applied Physics, Vol. 40, 5101–06, (December 1969). However, the electrohydrodynamic (EHD) spraying technique has principally been used only as a research tool for testing properties of singly charged and multiply charged ions and as an electric propulsion source. The full potential for the electrohydrodynamic spraying technique for forming new types of materials and ultra-fine particles has neither been fully appreciated nor developed to the extent where the potential applications of this technique could be applied in a commercially useful sense.

In particular, it has now been found that electrohydrodynamic spraying can be used to form sub-micron to micron size particles from metal alloys, ceramic materials and similar high melting point composite materials which never previously existed in that form. It has also been discovered that very thin coatings having superior properties can be formed from such materials.

Electrohydrodynamic Technology

The electrohydrodynamic (EHD) method for droplet generation involves the use of very intense electric fields which are obtained by exposing, at electrodes, a liquid having high curvature geometry using moderate voltages of about 3 to about 20 kilovolts. The electric field intersecting a liquid meniscus produces the very high electric fields needed for charged droplet generation. After generation, the droplets are then accelerated by the applied voltage.

The EHD technique for charged droplet generation initiates with a conductive liquid exposed to a high electric field at the tip of a small capillary tube. The interaction of the electrostatic stresses applied by the electric field with the surface tension forces on the liquid at the capillary tip results in a highly dynamic process at the charged liquid surface. When the outward force exerted on the liquid meniscus exceeds the surface tension forces, the surface disrupts by expelling droplets. Relatively intense fields on the order of about $10^5$V/cm or greater are required for droplet production and capillary needle emitters having an orifice on the order of about 75 microns are typically employed to yield the necessary field strengths to produce micron size particles. In contrast, using hydrostatic jets with no electric fields on similar emitters and under vacuum conditions will produce particles typically having diameters of between 110 and 150 microns. The field strength at the tip of a capillary electrode is directly related to the applied voltage and the capillary emitter dimensions.

The controllable variables in electrohydrodynamic droplet generation include, for example, the acceleration voltage, the electric field at the emitter, the emitter and extractor geometries, the conductive liquid feed rate and the temperature. The properties of the liquid metal feed is also a variable effecting the results. Electrohydrodynamically generated droplets are controlled in terms of radius, charge-to-mass ratio and velocity. The droplet trajectory and impact energy are controllable by means of electric and magnetic fields. In general, the droplet size can be increased by decreasing the electric field (voltage) and/or by increasing the flow rate of the liquid feed. With increasing size, the charge-to-mass ratio and the droplet velocity decrease and the time-of-flight from the source to a collector increase accordingly. The droplet velocity (v) can be defined in terms of the charge-to-mass ratio (q/m) and the acceleration voltage (V) according to the energy relation;

$$qV = \frac{1}{2} mv^2.$$

In general, if the EHD source current (I) and the mass flow-rate ($\dot{m}$) are measured, then the charged-to-mass ratio (q/m) of the emitted droplets can be determined by the following expression;

$$I = (q/m)\,\dot{m}.$$

The electrohydrodynamic droplet formation method is highly versatile with respect to the types of feed materials, particle sizes, particle size distribution, feed material and particle temperature control, coating characteristics and the like.

The feed material may be substantially any material: metallic or non-metallic, inorganic or organic, single element of alloy, mixtures, compounds, etc., the only requirements being that it can exist in the liquid (molten) state and be capable of being electrically charged.

A novel aspect of the present invention is the application of electrohydrodynamics to non-wetting liquids, such as metal alloys. The early studies with EHD spraying for the production of singly charged ions, as a propulsion source, in the nuclear field for studying thin film cross-sections, etc., involved feed materials which wetted the walls of the EHD spraying apparatus. In these prior art systems, therefore, flow control of the feed material could be accomplished, for example, by capillary action, by gravity flow or by simple mechanical pressure, such as pressure exerted on the liquid feed material by a piston. Also, totally different surface phenomena was observed, especially with respect to the geometry of the liquid meniscus at the capillary needle emitter, a concave geometry observed in a wetting system and a convex geometry being observed in a non-wetting system. The different geometrical patterns account for very significant differences in droplet formation as a result of differences in the interaction with the electrostatic field.

Particle sizes can be achieved for electrohydroynamically formed particles ranging from several microns (up to the dimension of the orifice of the capillary needle emitter) to sub-micron (down to singly charged ions). Particle size variables include the mass flow rate of the feed material to the capillary needle emitter, and the applied voltage. For fixed mass flow rate, as the applied voltage increases the droplets formed from the meniscus at the capillary tip break off faster, i.e. smaller size particle droplets having a higher charge-to-mass ratio are formed. For a fixed applied voltage, as the mass flow rate is decreased, so that the rate at which the liquid meniscus forms at the capillary tip decreases, the size of the formed droplet decreases, i.e. charge-to-mass ratio increases.

Other processing variables which effect particle size and particle size distribution of electrohydrodynamically formed particles include the position of the extractor or accel electrode relative to the tip of the capillary needle emitter and the electrostatic field. With metals and alloys it is possible to prepare substantially all singly charged ions. With other materials, e.g. semiconductors, ceramics, etc., narrow distributions of particle sizes can be achieved. Particle sizes ranging from about 0.01 micron to about 100 microns are possible.

Another novel aspect of the EHD spraying technique for fine size particle generation according to the present invention, involves the treatment of metals, metal alloys, ceramics and other high melting temperature materials, especially metal alloys such as iron alloys, aluminum alloys, rare earth metal alloys, transition metal alloys and the like having melting temperatures greater than about 500° C., especially greater than about 1000° C., and most especially greater than about 1500° C. For example, a Fe-P-C alloy at a weight ratio of iron to phosphorous to carbon of about 80-13-7 can be formed into ultrafine particles without phase separation.

In fact, it is now possible for the first time to process virtually any metal alloy into very fine particles ranging in size from about 100 microns to sub-micron size. Because of the extremely rapid quenching, on the order of about $10^6$ °K/sec or more, which can be achieved for these ultrafine size particles, simply by radiative cooling, or radiative cooling combined with conductive and/or free molecular flow, the particles can be solidified without separation of the different metal elements of the metal alloy. Iron, nickel, copper, aluminum and similar metal alloys can be electrohydrodynamically sprayed.

Furthermore, temperature control of the feed material in the processing apparatus provides for variations in material viscosity and therefore more precise control of feed material mass flow rate. Temperature also effects the thermal as well as electrical conductivities of the feed material so that control of temperature permits still further controls of particle sizes, particle size distributions, particle trajectories, particle cooling, etc.

With respect to formation of coatings the materials to be sprayed electrohydrodynamically can be varied in both throughput and species such that a target can have multilateral layers deposited coincidentally or sequentially. The ultra small droplet size enhances the physical properties of the coating by reducing skin stresses and enhances the optical properties by reducing the growth of crystallites in the film. Precise layers can be deposited from extremely thin films to relatively thick filters for optical characteristics into the infrared.

As previously stated, the most important applications of the electrohydrodynamic spraying technique of the present invention involve the formation of new alloys as well as new forms (ultrafine particle sizes, amorphous or crystalline) of old alloys and ceramics especially alloys and ceramics composed of high and low melting temperature elements, and in formation of thin film coatings for such uses as antireflection coatings, dichroic beam splitters, color and bandpass filters, color selective beam filters, narrow pass-band (interference) filters semi-transparent mirrors, heat control filters, high reflectivity mirrors, polarizers, reflection filters, semiconductor films, integrated circuits, and the like.

Accordingly, it is a principal objective of the present invention to provide a method for preparing amorphous or microcrystalline alloy and ceramic powders and products therefrom which are characterized by their formation at rapid cooling rates exceeding $10^6$ °K/sec and up to $10^{10}$ °K/sec. The desirability of a system that generates molten material microdroplets by the controlled stressing of a molten metal surface by intense electrostatic fields is apparent. The small metallic or ceramic spheroids possess a large surface-to-volume ratio and, additionally, the cooling rate is inversely proportional to the droplet radius. It is a further object of this invention to provide an improved system for the generation and control of high temperature, non-wetting molten metal droplets in the size range conductive to rapid quenching rates. It is a further object of the present invention to provide a novel apparatus having a single or plurality of refractory nozzles (capillary needle emitters) for the production of molten metal droplets. Further, it is an object of the present invention to provide an improved means of droplet generation that relates specifically to the quenching from the liquid state to produce nonequilibrium effects in solids, i.e., noncrystalline (amorphous) structures, extended solid solubilities, new metastable phases or distinctive microstructures and alloys composed of high and low melting temperature constituents difficult to alloy by any other means. It is an object of the present invention to provide an atomization system that does not require the formation of liquid metal streams or use of a complex gas system, requires no moving parts, and eliminates the need for the stock or feed material to be reduced to the powder form before processing. Further, an object of this invention is to provide a means of continuously processing material, a clear advantage over batch ststems. An object of the present invention is to provide a means for eliminating the possibility of contamination or oxidation of the feed material droplets in transition between generation and collection (impact). Further, an object of the present invention is to extend the lower range of particle sizes presently achievable by the above-mentioned schemes. It is an object of this invention to provide higher quenching rates by providing smaller particles and to utilize the transition time of the droplets between generation and impact as an effective means of cooling by radiative heat transfer. It is a further object of this invention to provide a means of injecting the droplets into a background of low pressure inert gas such as argon to utilize the quenching effect of free molecular conductivity. In this case, provided the droplets are small enough, the gas atoms incident on the droplet surface afford a method of heat transfer by collision and emission at the surface temperature of the droplet. The present invention can also utilize a cooled substrate for quenching after impact similar to such conventional systems as described in the Background of the Invention, including, for example, the gun technique of splat cooling, gas atomization, centrifugal or rotary atomization, and plasma jet or arc spraying. Still further object of the present invention is to provide an apparatus for processing amorphous materials that is less complex and more economical than prior art devices.

It is another principal objective of the present invention to provide a method for preparing materials especially high melting temperature and non-wetting materials and depositing the material on a substrate by electrohydrodynamic spraying of materials in the liquid state.

Further, it is an object of the present invention to provide an improved means of droplet generation that relates specifically to the deposition from the liquid state to produce thin film on metallic or other material substrate. It is an object of the present invention to provide an electroatomization system that does not require the formation of evaporative liquid material streams or use of a complex boiler system, requires no moving parts, and eliminates the need for the stock or feed material to be evaporated from a boiler, elimination of carrier or catalyst, the reductions of contaminants in vacuo.

It is still another object of this invention to provide stable films by providing smaller particles and to utilize the rapid cooling of the droplets during flight and upon impact as an effective means of reducing crystallite buildup. The present invention can also utilize multiple sources for multimaterial deposition on the substrate. Still further object of the present invention is to provide an apparatus for processing thin films that is less complex and more economical than prior art devices.

SUMMARY OF THE INVENTION

These and other objectives of the present invention are accomplished with apparatus and method for electrohydrodynamically producing a beam of charged particles from a molten feed stock of a high melting temperature, non-wetting metal, metal alloy, semiconductor, ceramic or similar material contained in a refractory or other high temperture resistant non-corrosive container which is in flow communication with a refractory or similar material nozzle, the molten feed stock being subjected to precise temperature and mass flow rate control. The nozzle is a capillary needle emitter the tip of which is located in the same vertical plane as, or in a vertical plane slightly forward of or slightly behind an extractor or accelerating electrode; the tip is also located with its axis coinciding with the midpoint of an aperture in the extractor electrode. The droplet sources, including the crucible, feedstock, nozzle, extractor or accel electrodes, heating and temperature control elements as well as the droplet collection system are all, preferably, housed in a vacuum housing maintained at low pressure (about $10^{-6}$ torr. to about 0.5 torr). The metal alloy or other source material is fed into the refractory crucible in the evacuated chamber where it is melted and maintained at a precise temperature.

Pneumatic pressure, using an inert gas, such as argon, forces the molten feed material from the crucible to the capillary needle emitter which is positively charged using moderate voltages of about 3 to 20 kilovolts and also temperature controlled. The liquid meniscus which forms at the orifice of the capillary needle emitter is intersected by the field lines of the electrostatic field. The interaction of the electrostatic stresses with surface tension force results in a highly dynamic process at the charged liquid surface. When the outward force exerted on the liquid meniscus exceeds the surface tension forces the surface disrupts by expelling droplets. In this process the electric field causes the liquid meniscus to form liquid jets or spikes which in turn produce the very high electric fields (about $10^5$ volts/cm) needed for charged droplet generation. After generation, the positively charged droplets are then accelerated by the applied electric field, across the gap between the orifice of the nozzle tip and accel electrode to form a diverging beam. The angle of divergence of the droplet beam is a function of the applied voltage, charge-to-mass ratio, position of the accel electrode and the electrical repulsion between the like-charged droplets.

The droplets are eventually collected either by impinging on a collector-target and forming a thin film coating or by simple solidification as discrete particles. The target may be electrically controlled to effect the impact of the charged particles. Cooling rates are affected by particle sizes and ambient conditions. Radiation, convection, conduction and free molecular flow are all available means of heat transfer. Droplet cooling by radiation is a function of several parameters, of which the following are the most important: droplet size and material; heat of fusion; spectral emissivity; temperature; thermal conduction; velocity; and cooling media.

For a typical feed material, assuming an applied voltage in the range of about 2 to about 10 kilovolts and a distance of about 1 meter between the capillary needle emitter and the target, cooling rates on the order of $10^6$ to $10^8$ °K/sec, mass flow rates of about $10^{-5}$ to $10^{-2}$ g/sec, charge-to-mass ratios of about $10^{-1}$ to $10^5$ coulomb/kilogram, droplet velocities of about $10^4$ to $10^6$ cm/sec and droplet time-of-flight (TOF) of about $10^{-4}$ sec can be obtained.

BRIEF DESCRIPTION OF THE DRAWINGS

The foregoing and other features of the invention will be better understood from the following detailed description and the accompanying drawings in which.

DESCRIPTION OF THE PREFERRED EMBODIMENT

Figure 1:
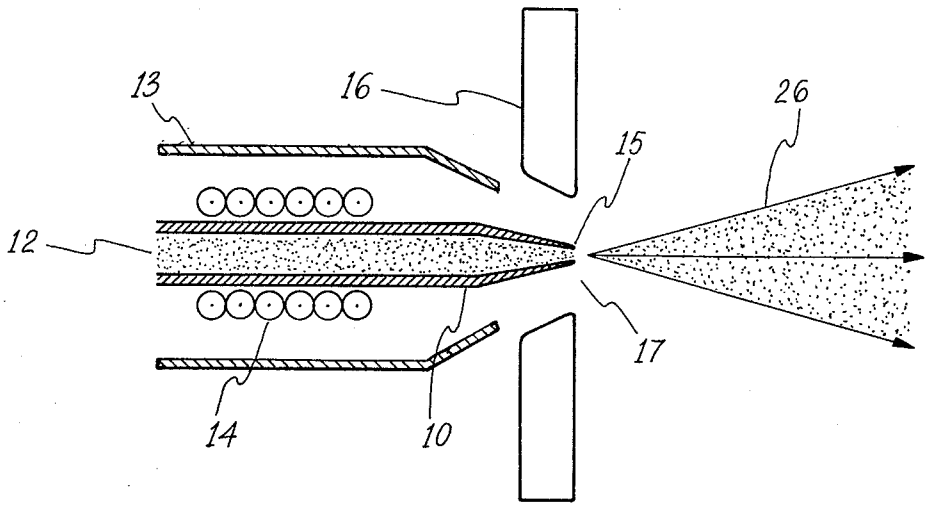
FIG. 1 is a cross-sectional view of one embodiment of the tubular or slit droplet source (capillary needle emitter) in accordance with the present invention.

Referring now to FIG. 1, the apparatus includes a refractory nozzle 10, which can operate singularly or ganged together to form a plurality of nozzles. For the high melting temperature materials of interest commercially available nozzle materials include, for example, tungsten, tungsten carbide, alumina, beryllia, thoria, yttria, zirconia and the spinels. The refractory material must be chemically inert with respect to the sources material. The source material will also be non-wetting with respect to the refractory material. A molten metal alloy 12 or other material such as a molten metal, or molten ceramic, et cetera flows through the nozzle 10 where it is kept in the molten condition at a fixed temperature by a nozzle heater 14, which can be one of several types; for example, R-F, radiation or the preferred type as illustrated in FIG. 1, a metal sheathed, ceramic insulated heater wire held in intimate thermal contact with the nozzle 10 affixed to the nozzle by vacuum furnace brazing. A heat shield 13 helps to maintain constant temperature conditions. An accel or extractor electrode 16 is located in proximity to nozzle 10. The accel electrode 16 is a thin metallic plate, preferably also made from a refractory element to avoid high temperature problems. For symmetry considerations, the accel electrode 16 is usually circular, if the source is tubular, but it is possible to utilize other shapes. The accel electrode 16 contains a circular aperture 17, if tubular. In the preferred embodiment of this invention, the circular opening has a diameter whose dimensions are on the order of 1/16 inch to ⅛ inch. When a plurality or array of nozzles are employed, a single accel electrode 16 can be employed with multi-apertures to provide the individual electrode systems required to establish the intense electric field at each of the nozzles comprising the array. The nozzle 10, or tubular droplet source tapers from a large diameter and terminates in a short capillary tip 15. In the preferred form of this invention, the capillary tip 15 should taper down to an outer diameter in the range of about 0.0010 to about 0.020 inch, preferably about 0.003 to about 0.01 inch at the tip. The orifice diameter has dimensions at the tip typically on the order of about 0.0003 to about 0.012 inch, preferably about 0.0005 to about 0.008 inch. These small dimensions are necessary to enhance the electric field applied to the molten alloy-vacuum interface. The refractory nozzle 10 is positioned coaxially with the extractor or accel electrode 16 with the nozzle tip 15 centered in the aperture 17. The preferred alignment of the nozzle-electrode system consists of placing the nozzle tip 15 in the accel aperture 17 such that the nozzle tip and front surface of the accel electrode 16 lie in the same plane. Although this alignment is preferred, satisfactory operation can be obtained if the nozzle tip 15 is positioned either directly behind the rear surface of the accel electrode 16 or is allowed to extend slightly forward of the front surface of the accel electrode. The particular alignment of the nozzle tip and accel electrode can be varied to modify the electrostatic field and hence, particle size distribution and particle trajectory. The nozzle 10, is constructed preferably from a refractory metal or oxide material resistant to any corrosion by the type of molten material processed and which is able to withstand temperatures of 1700° C. and more, especially 2000° C. or more.

As seen in FIG. 1, according to a particularly preferred geometry, the capillary nozzle tip should taper at an angle of about 15° and the aperture 17 should similarly taper at an angle of about 15° to about 25° from its back surface to its front surface (from left to right as seen in FIG. 1). It has also been found that best results are obtained when the nozzle tip at the orifice is slightly rounded to provide a cylindrical outlet.

Figure 2:
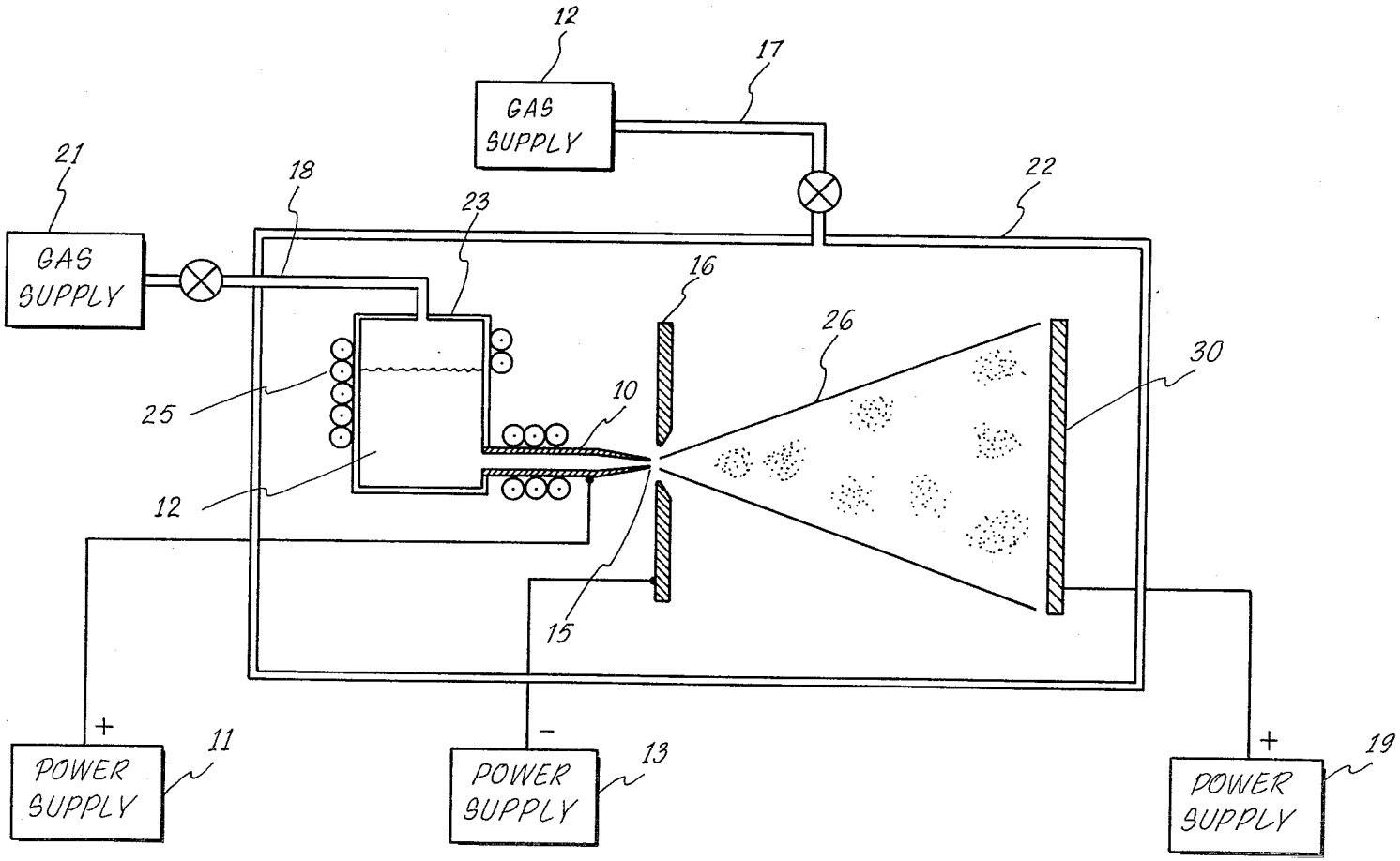
FIG. 2 is a schematic diagram of one embodiment of the materials processing apparatus in accordance with the present invention.

With the aid of FIG. 2, the features of the materials processing apparatus according to the present invention, will now be described. A metal alloy 12, ceramic charge, etc. is placed in the refractory reservoir 23, or crucible which may be formed from the same material as nozzle 10. The charge is melted by means of the crucible heater 25. The molten charge is then delivered to the capillary nozzle 10, by means of applying a positive pressure through the pressurizing tube 18 from an inert gas supply source 21, for example, argon. The pressurizing tube 18 serves the dual purpose of vacuum (not shown) or pressure line. When the molten charge approaches the nozzle tip 15, it enters a region of intense electrostatic field established by the application of high positive voltage to nozzle 10, by means of power supply 11. The electric field is maintained between the positively charged nozzle tip 15 and the extractor or accel electrode 16, held at a negative potential of about −500V provided by means of power supply 13. The negative potential at the extractor electrode 16 also serves to control the amount of backstreaming electrons which bombard the tip 15 during operation. The relatively intense fields generated at tip 15 ($>10^5$V/cm) result in electrostatic stresses at the exposed molten alloy meniscus. The resulting interaction with the opposing surface tension forces produces a highly-dynamic process at the charged liquid metal alloy surface. When a critical value of electric field is approached, nominally at voltages of 2 to 5 kilovolts, the electrostatic forces overcome the surface tension forces tending to hold the liquid together. The liquid surface disrupts into an aggregate of positively charged droplets as depicted in FIG. 2. The droplet beam 26, is subsequently accelerated across the gap and impinges on the collector or cooling substrate 30. In one configuration of the present invention, the droplet collector 30 can be stationary, thereby fixing the droplet transit distance. An alternate embodiment of the invention allows for a deployable collector capable of translating in either direction along the elongated axis of the nozzle. This allows the flexibility to collect the emitted droplets in the molten, partially solidified or solidified phase as desired by providing controlled variations in the cooling time before collection. A further embodiment of the present invention accomplishes the variations in the time-of-flight of the molten microdroplets before impingement by means of applying a positive deceleration voltage to collector 30 provided by power supply 19. A novel feature of the present invention becomes apparent by replacing the electrically conducting substrate or collector by a nonconducting substrate. When positively charged droplets impinge on the collector, the resulting buildup of charge generates a floating potential at the collector surface, providing a novel means for decelerating the microdroplets. In addition to varying the transit time, a further advantage of decelerating the microdroplets is to reduce the energy of impact which avoids unwanted heating of the substrate.

The particle dimensions generated by this process range from singly charged ions to droplet sizes on the order of the tip orifice dimensions. Droplet sizes are controlled by adjusting either the pressure supplied by an inert gas from supply 21, through the pressurizing line 18, or the voltage applied to nozzle 10, by means of power supply 11. The entire droplet source, comprised of reservoir 23, nozzle 10, and electrode 16, is housed in the vacuum chamber 22. Operation of the system has been performed at vacuums down to about $10^{-5}$ to about $10^{-6}$ torr. Since the present invention is capable of generating smaller metallic or ceramic spheres in a controlled fashion than is possible by any other technology, the formation of the microspheres can be controlled to allow the droplets to impinge in the molten form on substrate 30, where quenching occurs by direct thermal contact, that is, by heat conduction into the substrate 30, cooled by a suitable means.

The system can also be operated at higher pressures up to atmospheric pressure or even slightly higher than atmospheric. However, operation in a vacuum assures greatest purity of the resulting product since the probability of entrapping residual gases becomes remote in high vacuums.

On the other hand, there will be certain applications where it may be desirable to entrap impurity or dopant molecules in the molten droplets prior to solidification and impingement. The present invention offers this versatility by providing an optional gas supply 32 and conduit 33.

While the system provides sufficient flexibility to adjust the process variables such that quenching of the molten particles takes place by direct thermal contact with the target 30, it is also possible that the particles can be rapidly quenched from the liquid to solid state by radiative heat transfer in flight between nozzle 10 and collector 30. For radiative heat transfer to be effective, it is essential that spheres of small dimensions be produced to experience cooling rates on the order of $10^6$ °K/sec and higher. The versatility of the present invention is readily apparent when it is understood that "in-flight" radiative cooling is not the only means by which rapid cooling to produce amorphous or microcystalline structures can be accomplished. The formation of the microspheres can be controlled to allow the droplets to impinge in the molten form on substrate 30 where quenching occurs by direct thermal contact, i.e., by heat conduction into the substrate 30 cooled by a suitable means. While it is presently contemplated that the preferred form of the invention would utilize radiative cooling to accomplish the processing of rapidly quenched material, it will be appreciated that another form of the invention allows for rapid cooling by free-molecular heat transfer. In this form, an inert gas such as argon provided by means of gas supply 32 is bled into the chamber 22 by means of the chamber pressurizing line 33. The chamber pressure is maintained at a pedetermined level which satisfies the requirement that the dimensions of the droplets generated by the nozzle 10 are small compared with the mean free path of the background gas atoms. Other advantages of the application of electrohydrodynamic spraying for ultrafine droplet formation and preparation of thin film coatings include that the material source does not need any catalyst or carrier material added such that no material other than the desired material evolves from the source which is directed in a narrow electrostatically focused beam and virtually all of the source material will impact on the target (substrate). The narrow beam is from a narrow emission aperture such that there will be nil neutral efflux so that high vacuum may be maintained in a practical manner, and thereby reduce entrapped gases in the film. Thermal control of the material may permit sticking characteristics that are different from normal vapor condensation phenomena. This temperature control of the beam material may also enhance crystalline or amorphous structure of the film.

What we claim is:

1. A method of forming high melting temperature metal alloys in the form of ultrafine particles ranging in size from sub-micron to about 100 microns by electrohydrodynamic spraying which comprises:

liquefying the metal alloy;

pneumatically feeding the molten metal alloy to a capillary nozzle to form a liquid meniscus at the tip of the nozzle;

applying a positive electric field to the molten metal alloy to create electrostatic forces which are high enough to overcome the surface tension of the liquid meniscus to thereby generate a beam of positively charged ultrafine droplets of said metal alloy;

solidifying the ultrafine droplets; and collecting the resulting ultrafine metal alloy particles.

2. The method of claim 1 which is carried out in a vacuum chamber evacuated to at most about 0.5 atmospheres.

3. The method of claim 2 wherein said vacuum is about $10^{-5}$ to about $10^{-6}$ torr.

4. The method of claim 1 wherein said droplets range in size from about 0.01 microns to about 1 micron.

5. The method of claim 1 wherein the droplets of said molten metal alloy are collected in the form of a thin film coating by impinging the droplets on a target substrate before said droplets completely solidify.

6. The method of claim 5 wherein said target substrate is positively charged to cause said positively charged droplets to decelerate before impinging on said target.

7. The method of claim 5 wherein said target substrate is non-conductive and wherein when said positively charged droplets impinge on said substrate the resulting buildup of charge generates a floating positive potential at the substrate surface to thereby decelerate the remaining positively charged droplets.

8. The method of claim 1 wherein said metal alloy has a melting temperature of over 500° C.

9. The method of claim 1 wherein said metal alloy is an iron, nickel or copper alloy having a melting temperature of at least 1000° C. and is non-wetting with respect to the capillary nozzle material.

* * * * *